United States Patent [19]

Almblad

[11] Patent Number: 4,677,835

[45] Date of Patent: Jul. 7, 1987

[54] PLASTIC CARD/KEY COMBINATION AND HINGE STRUCTURE

[75] Inventor: Robert Almblad, Phoenix, Ariz.

[73] Assignee: Donald Almblad, Morton Grove, Ill.

[21] Appl. No.: 850,155

[22] Filed: Apr. 10, 1986

[51] Int. Cl.[4] ..... A47G 29/10

[52] U.S. Cl. ..... 70/456 R; 70/457; 70/458

[58] Field of Search ..... 70/456 R, 457, 458, 70/459; 40/2 A, 330; 206/37–37.8; D3/61, 62

[56] References Cited

U.S. PATENT DOCUMENTS

| | | | |
|---|---|---|---|
| D. 174,543 | 4/1955 | Goessling | D3/62 X |
| D. 245,371 | 8/1977 | Mowry | D3/61 |
| D. 259,073 | 5/1981 | Holmes | D3/61 |
| D. 278,574 | 4/1985 | Kilpatrick | D3/61 |
| 1,766,599 | 6/1930 | Cahill | 70/456 R X |
| 2,228,726 | 1/1941 | Loesch | 70/456 B |
| 2,322,920 | 6/1943 | Campbell | 206/37.4 X |
| 2,488,240 | 11/1949 | Rumsey | 206/37.6 X |
| 2,625,190 | 1/1953 | Dimond | 206/37.6 |
| 2,734,624 | 2/1956 | Kernicki | 70/456 R |
| 3,101,762 | 8/1963 | Bermingham et al. | 206/37.3 |
| 3,212,546 | 10/1965 | Lind | 206/37 X |
| 3,318,354 | 5/1967 | Borisof | 206/37 X |
| 3,481,168 | 12/1969 | Unter | 70/457 X |
| 4,037,716 | 7/1977 | Marks | 70/456 R X |
| 4,286,641 | 9/1981 | Watson | 206/37 X |

FOREIGN PATENT DOCUMENTS

| | | | |
|---|---|---|---|
| 3242766 | 5/1984 | Fed. Rep. of Germany | 70/456 R |

*Primary Examiner*—Robert L. Wolfe
*Assistant Examiner*—Suzanne L. Dino
*Attorney, Agent, or Firm*—Hill, Van Santen, Steadman & Simpson

[57] ABSTRACT

A key and card combination formed from molded plastic material comprises a key-shaped recess socket in the plane of the card, a key being separably located in the recess socket and formed in one piece with the card, and integral multidirectional hinge structure formed from the same material as the key and card and integrally connects an edge of a head end of the key to an edge of the card in the socket. The hinge adapts the key to be swung out of and swung back into the plane of the card. When the key is swung out of the plane of the card, the key is enabled to be twisted in various directions relative to the card on and about the hinge, laterally or about the axis of the hinge. In a preferred construction, the hinge structure comprises a rod-shaped elongated element.

20 Claims, 7 Drawing Figures

PLASTIC CARD/KEY COMBINATION AND HINGE STRUCTURE

BACKGROUND OF THE INVENTION

This invention relates to a novel plastic card/key combination and hinge structure, and is, more particularly, an improvement on the unique Key and Retainer Card Combination disclosed in the pending application of Donald F. Almblad, Ser. No. 619,936, filed June 12, 1984 U.S. Pat. No. 4,637,236.

In the prior application, it was pointed out that automobile keys, house keys, and the like, which are virtually universally adapted for operating tumbler locks, are generally supplied loosely in envelopes, or on key rings or key holders of various types. This is true for original issue keys, duplicate key sets and replacement keys.

Carrying of emergency duplicate keys generally presents a problem. Loose keys are extremely inconvenient to carry or store for emergency use, and this is particularly true of automobile keys. One expedient for making duplicate automobile keys available has been by placing them in a magnetic container which can be held magnetically to an accessible ferrous part of an automobile. The magnetic containers, however, are liable to be dislodged and lost. Carrying loose duplicate keys in a wallet, purse, or garment pocket has obvious limitations and is generally inconvenient.

According to the prior application, there has been provided a new and improved key and card combination, comprising a key carrying card, at least one key recess in the card, a key in the recess, and hinge means separably retaining the key in the recess by connecting a head end edge of the key to an edge of the recess. The hinge means there disclosed comprises a thin hinge web which functions satisfactorily for simply hinging the key into and out of the recess, that is in directions perpendicular to the plane of the card. However, when the key is twisted or laterally shifted relative to the card after being swung out of the plane of the card, the thin web hinge has proven to be unstable and quite susceptible to breakage, having regard to the most desirable type of plastics material from which the key and card combination may be molded.

It is to the alleviation of the hinging problem and to stabilization of the key relative to the card regardless of stresses and strains that may be placed upon the hinge, that the present invention is directed.

Therefore, the present invention provides a key and card combination formed from molded plastic material, comprising a key-shaped recess socket in the plane of the card. A key is separably located in the recess socket and is formed in one piece with the card. An integral multidirectional hinge means is formed from the same material as the key and card, and integrally connects an edge of a head end of the key to an edge of the card in the socket and adapts the key to be swung out from and swung back into the plane of the card, and the hinge means comprises a construction permitting the key to be not only swung as aforesaid, but also enabling twisting of the key relative to the card on and about the hinge.

In the best mode, the hinge means comprises an elongated generally rod-shaped element.

BRIEF DESCRIPTION OF THE DRAWINGS

Other objects, features and advantages of the present invention will be readily apparent from the following description of a representative embodiment thereof, taken in conjunction with the accompanying drawing, although variations and modifications may be effected without departing from the spirit and scope of the novel concepts embodied in the disclosure, and in which.

Figure 1:
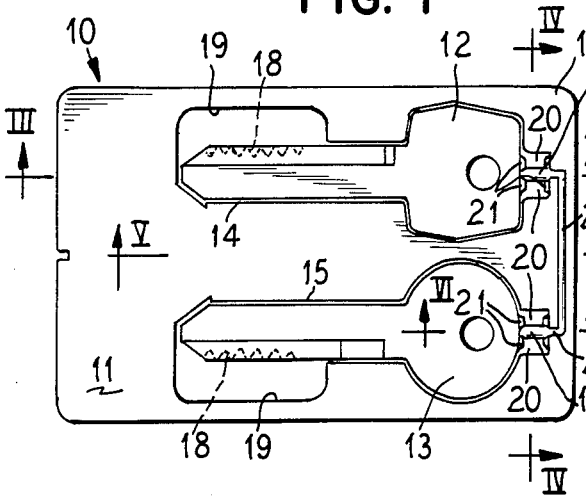
FIG. 1 is a plan view of one side of a key and card combination embodying the invention.

In one preferred form of the present invention, a key and retainer card combination 10 comprises a convenient, preferably generally wallet (e.g., credit card) size card 11 carrying at least one, and as shown a pair of car (automobile) keys 12 and 13. For example, the key 13 may be a car door and trunk lock key, and the key 12 may comprise an ignition key.

Figure 3:
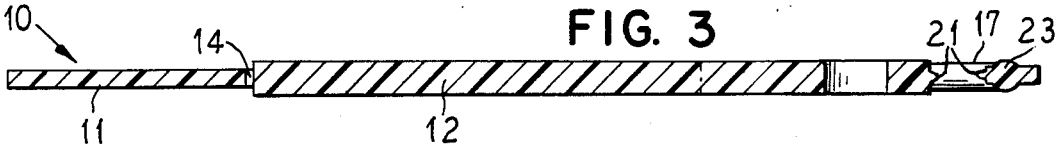
FIG. 3 is a longitudinal sectional detail view taken substantially along the line III—III in FIG. 1.
Figure 4:
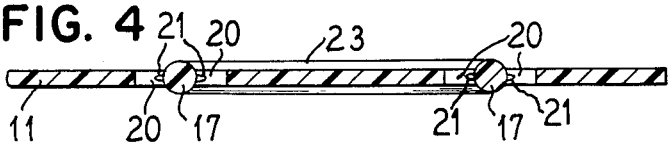
FIG. 4 is a sectional detail view taken substantially along the line IV—IV in FIG. 1.

The card 11 and the keys 12 and 13 are desirably made from the same material, and more particularly a plastics material (synthetic resin) which can be readily molded to provide the combination and which will, in the dimensions required for the purpose, provide adequate stiffness, without brittleness in both the card and the keys since they are both made integrally, and connected together, from the same material. As depicted in FIG. 3, the card 11 may be of a relatively thin section, such as that commonly present in wallet size plastic credit cards, e.g., on the order of 0.047"thick. Conveniently, the card may be about 3⅜"long by about 2" wide. The keys 12 and 13 should be as long as and of a width equivalent to the conventional metal keys which the keys 12 and 13 simulate. A thickness of about 0.095"has been found especially suitable for the key thickness. By having the card thinner than the key, and the key of a thickness greater than that of the card, certain advantages are gained such as minimum weight, economical use of material, and location of the key by feel in the dark, or by a sightless person, is facilitated. Further, although the card may be somewhat resiliently flexible, the key should be substantially stiffer in order to withstand normal use. Of course, if preferred, the card and the key may be of the same thickness as desired for the key thickness, having regard to the plastics material employed. A preferred material comprises acetal resin which is a polymerized formaldehyde and is manufactured by, among others, E.I. Dupont De Nemours & Company under the trademark "". Delrin 500 has been found to give best overall results.

In a desirable arrangement, the keys 12 and 13 are located in the plane of the card, in respective key recesses or sockets, there being a socket 14 for the key 12 and a socket 15 for the key 13. In general the sockets and the keys are complementary, so that the edges of the socket and key, in each instance, are relatively closely adjacent. The narrow clearance or tolerance relative to the edges of the keys and the adjacent edges defining the sockets is such as to readily accommodate the keys in the sockets in a manner which will facilitate displacement of the keys from the socket as desired.

Each of the keys 12 and 13 is permanently attached in one piece to the card 11 by hinge means 17 formed integrally with the edge of the head end of the key and integrally with the adjacent socket edge of the card. In other words, the hinge means 17 is formed integrally in one piece with the key and the card and connects the key to the card in each instance. This permits the key/-card combination to be conveniently injection molded, which has been found to be a commercially satisfactory expedient for producing the key/card combination.

Figure 2:
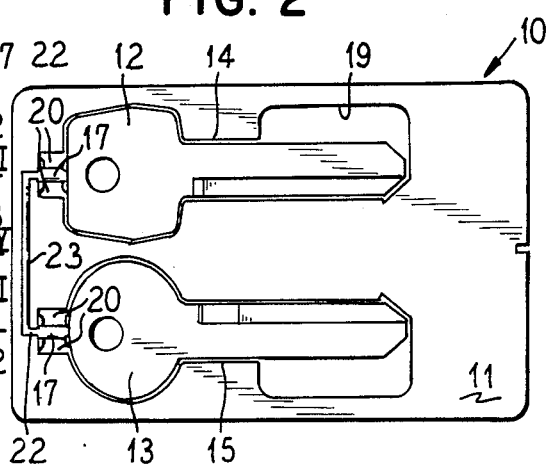
FIG. 2 a plan view of the opposite side of the key and card combination.

The keys 12 and 13 are formed with the usual longitudinal ribs and grooves in their shanks complementary to the key slots in the locks for which the keys are intended. As fabricated, the keys 12 and 13 may be simply blanks, each intended for a certain type of lock, for example, for the lock of a particular make of model of an automobile, or of whatever type of lock for which intended. Since each lock has a particular tumbler code, each key must have its shank provided with notches 18 for the particular tumbler code for which intended. The notches are adapted to be cut into the shank edge by chipping or clipping or punching out by means of a tool or machine intended for that purpose. To facilitate the cutting of the notches, the respective recesses or sockets 14 and 15 are provided with clearance enlargements 19 along the key shank edges to be notched, for permitting adequate access for the cutting tools or punches used for the purpose. For example, car dealers may have a key cutting machine which operates in accordance with a numerical code for cutting the desired ignition keys and the desired door and trunk keys and which may serve the purpose. On the other hand, the key notches may be cut in accordance with original metal keys used as templets in a machine that duplicates the key notches in the plastic key blanks carried by the card to conform with the templet keys. It will be understood, of course, that the key edges to receive the notches 19 will in the newly fabricated condition be straight edges as indicated in full outline in FIGS. 1 and 2 while the notches which are selective for any given key are shown in dash outline.

Each of the hinge means 17 comprises a new and improved construction which will not only permit the respective keys 12 and 13 to be swung back and forth out of and into the plane of the card 11, but will also enable twisting of the keys relative to the card on and about the hinge means. In a particularly advantageous construction, each of the hinge means 17 comprises a generally rod-shaped elongated element. In a desirable structure, the hinges 17 may be about 0.080" in diameter and about ⅛" (0.125") in length. It will be appreciated that thereby the rod diameter of the hinge 17 is slightly less than the thickness of the key, but greater than the thickness of the card. A generally cylindrical cross section has been found particularly useful.

At each side of each of the hinges 17, there is a clearance recess 20 which is useful not only to facilitate the injection molding operation but also to provide desirable range of freedom of movement of the hinge 17 laterally after the key has been swung out of the plane of the card and is manipulated for the intended purpose. At juncture of the integral hinge 17 with the head of the associated key as well as at juncture with the card, in each instance, a lateral base lug reinforcement 21 is provided which strengthens the joinder of the hinge 17 to the key head. Not only for injection molding facility, but also for the thorough anchorage of the end of the hinge 17 connected to the card 11, a thickened integral reinforcement extension 22 is provided from the attached end of the hinge onto the card. Desirably, the thickened reinforcement extensions 22 are connected by a reinforcing rib 23 of similar cross sectional dimension. The rib 23 not only facilitates the molding process, but also desirably stiffens the card 11 between the adjacent head end areas of the key socket recesses 14 and 15.

Figure 5:
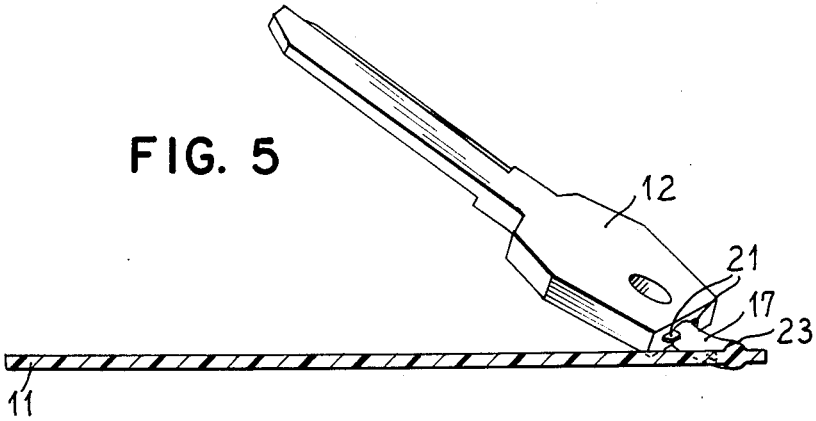
FIG. 5 is a sectional detail view taken substantially along the line V—V in FIG. 1 and showing the key swung out of the plane of the card.
Figure 6:
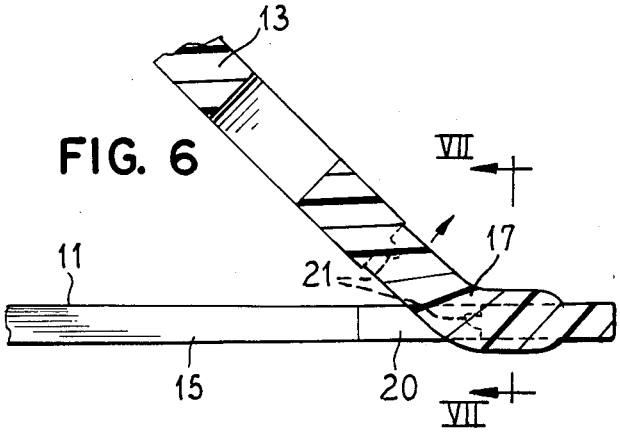
FIG. 6 is an enlarged fragmentary sectional detail view taken substantially along the lines VI—VI in FIG. 1, but showing in enlarged detail the hinge when the card is swung out of the plane of the card.
Figure 7:
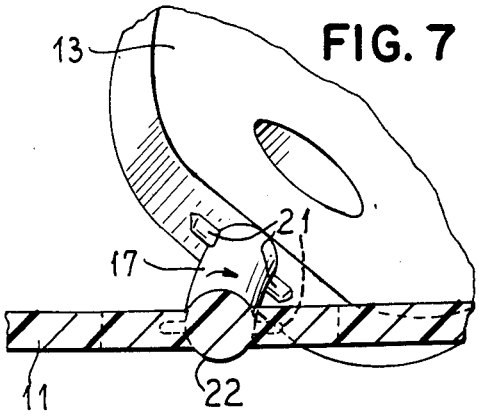
FIG. 7 is a fragmentary sectional detail view taken substantially along the line VII—VII in FIG. 6.

As shown in FIGS. 5 and 6, the hinge 17 readily bends to permit swinging of the key out of the plane of the card 11. Although shown only as swung out of the plane at one face of the card, it will be readily appreciated that the key may be swung with equal facility out of the plane of the card relative to the other face of the card. After the key has been deflected relative to the plane of the card, either by twisting the key about the axis of the rod hinge 17 and relative to the plane of the card within the associated recess socket as shown in FIG. 6, or swung fully from the plane of the card as shown in FIG. 5, the key may be further deflected throughout a wide range laterally and/or twisted about the flexible hinge 17 as may occur in normal use of the key, and without detaching the key from the card. After use, the key can be readily returned to the plane of the card for storage purposes such as replacement into a card pocket in a wallet. It has been found that the hinge 17 enables a large number of normal key uses, with attendant bending and twisting of the hinge, without breaking, by virtue of the unique construction of the hinge 17.

It will be understood that variations and modifications may be effected without departing from the spirit and scope of the novel concepts of the present invention.

I claim as my invention:

1. A key and card combination formed from molded plastic material and presenting a one-piece unitary molding, comprising:

a key carrying card with a key-shaped recess socket in the plane of the card;

a key separably located in the recess socket and formed in one piece with the card, and as an integral part of said molding;

and integral multidirectional hinge means comprising a unitary part of said molding and formed from the same material as the key and card and integrally connecting an edge of a head end of the key to an edge of the card in said socket and adapting the key to be swung out from and swung back into the plane of the card; and said hinge means comprising a generally rod-shaped elongated element permitting the key to be not only swung as aforesaid, but enabling twisting of the key relative to the card on and about said hinge.

2. A key and card combination according to claim 1, wherein said rod-shaped hinge element is of generally cylindrical cross section.

3. A key and card combination according to claim 1, wherein said key is thicker than the card, and the rod-shaped hinge is also thicker than the card.

4. A key and card combination according to claim 1, wherein said hinge element is of a diameter greater than the thickness of the card.

5. A key and card combination according to claim 1, wherein said hinge element is on the order of twice as long as its diameter.

6. A key and card combination according to claim 1, including reinforcements connecting the hinge element to respectively the edge of the head end of the key and to the card.

7. A key and card combination according to claim 6, in which the reinforcements comprise lateral reinforcing lugs.

8. A key and card combination according to claim 6, wherein the reinforcement connecting the hinge element to the card comprises a rib-like extension from the hinge element.

9. A key and card combination according to claim 8, including a pair of keys of similar structure and carried in like manner by the card and each key hinge having said rib-like extension, and a reinforcing rib connecting said rib extensions.

10. A key and card combination formed from molded plastic material and presenting a one-piece unitary molding, comprising:

a key carrying card with a key-shaped recess socket in the plane of the card;

a key separably located in the recess socket and formed in one piece with the card, and as an integral part of said molding;

and integral multidirectional hinge means comprising a unitary part of said molding and formed from the same material as the key and card and integrally connecting an edge of the head end of the key to an edge of the card in said socket and adapting the key to be deflected relative to the plane of the card; and said hinge means comprising a construction permitting the key to be not only delfected as aforesaid, but enabling twisting of the key in various directions relative to the card on and about said hinge means.

11. A key and card combination according to claim 10, wherein said hinge means comprises a generally rod-shaped elongated element connected integrally at one end to the key head end edge and connected integrally at its opposite end to the card.

12. A key and card combination according to claim 11, wherein said rod-shaped hinge element is of generally cylindrical cross section.

13. A key and card combination according to claim 11, wherein said key is thicker than the card, and the rod-shaped hinge is also thicker than the card.

14. A key and card combination according to claim 11, wherein said hinge element is of a diameter substantially greater than the thickness of the card.

15. A key and card combination according to claim 11, wherein said hinge element is on the order of twice as long as its diameter.

16. A key and card combination according to claim 11, including reinforcements connecting the hinge element to respectively the edge of the head end of the key and to the card.

17. A key and card combination according to claim 16, in which the reinforcements comprise lateral reinforcing lugs.

18. A key and card combination according to claim 16, wherein said reinforcement connecting the hinge element to the card comprises a rib-like extension from the hinge element.

19. A key and card combination formed from molded plastic material, comprising:

a key-shaped recess socket in the plane of the card;

a key separably located in the recess socket and formed in one piece with the card;

and integral multidirectional hinge means formed from the same material as the key and card and integrally connecting an edge of a head end of the key to an edge of the card in said socket and adapting the key to be swung out from and swung back into the plane of the card;

said hinge means comprising a generally rod-shaped elongated element permitting the key to be not only swung as aforesaid, but enabling twisting of the key relative to the card on and about said hinge; and said key being thicker than the card, and said rod-shaped hinge being thicker than the card.

20. A key and card combination according to claim 19, including reinforcements connecting the hinge element to respectively the edge of the head end of the key and to the card, said reinforcements comprising lateral reinforcing lugs, and the reinforcement connecting the hinge element to the card comprising a rib-like extension from the hinge element.

* * * * *